US008515317B2

(12) United States Patent
Yoshimoto et al.

(10) Patent No.: US 8,515,317 B2
(45) Date of Patent: Aug. 20, 2013

(54) DEVELOPER CONVEYANCE DEVICE, DEVELOPING DEVICE, AND IMAGE FORMING DEVICE

(75) Inventors: Shinichi Yoshimoto, Toyohashi (JP); Osamu Maeda, Sanda (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 179 days.

(21) Appl. No.: 13/063,993

(22) PCT Filed: Sep. 8, 2009

(86) PCT No.: PCT/JP2009/065662

§ 371 (c)(1), (2), (4) Date: Mar. 15, 2011

(87) PCT Pub. No.: WO2010/032657

PCT Pub. Date: Mar. 25, 2010

(65) Prior Publication Data

US 2011/0170911 A1 Jul. 14, 2011

(30) Foreign Application Priority Data

Sep. 18, 2008 (JP) ..... 2008-239031

(51) Int. Cl.
*G03G 15/08* (2006.01)

(52) U.S. Cl.
USPC ..... 399/254; 399/256

(58) Field of Classification Search
USPC ..... 399/254, 256; 222/DIG. 1
See application file for complete search history.

(56) References Cited

U.S. PATENT DOCUMENTS

| | | | | |
|---|---|---|---|---|
| 7,536,138 | B2 * | 5/2009 | Hirota | 399/254 |
| 7,881,638 | B2 * | 2/2011 | Noguchi et al. | 399/254 |
| 8,086,143 | B2 * | 12/2011 | Nagayama et al. | 399/254 |
| 2006/0204283 | A1 | 9/2006 | Yasuda | |
| 2009/0092419 | A1 * | 4/2009 | Iwata et al. | 399/254 |

FOREIGN PATENT DOCUMENTS

| | | | |
|---|---|---|---|
| JP | 6-067542 | A | 3/1994 |
| JP | 6-167876 | A | 6/1994 |
| JP | 10-142927 | A | 5/1998 |

(Continued)

OTHER PUBLICATIONS

Notification of Transmittal of Translation of the International Preliminary Report on Patentability (Form PCT/IB/338) dated Apr. 28, 2011, issued in corresponding International Patent Application No. PCT/JP2009/065662 by the International Bureau of WIPO.

(Continued)

*Primary Examiner* — Sophia S Chen
(74) *Attorney, Agent, or Firm* — Buchanan Ingersoll & Rooney PC

(57) ABSTRACT

There is provided a developer conveyance member that conveys a contained developer from one end side of a delivery region to other end of the delivery region while agitating the contained developer in a developer container, in which the developer is contained. Around a rotation shaft of the developer conveyance member, a spiral wing toward from one end side to other end side is formed. A plurality of paddle parts for conveying the developer in a direction that is perpendicular to a shaft core are formed around the rotation shaft in a delivery region. The paddle parts are arranged with their positions deviated in a circumferential direction.

21 Claims, 7 Drawing Sheets

(56) References Cited

FOREIGN PATENT DOCUMENTS

| | | | |
|---|---|---|---|
| JP | 2000-098715 | A | 4/2000 |
| JP | 3070414 | U | 8/2000 |
| JP | 2006-098540 | A | 4/2006 |
| JP | 2006-251440 | A | 9/2006 |
| JP | 2008-122764 | A | 5/2008 |

OTHER PUBLICATIONS

International Preliminary Report of Patentability (Form PCT/IB/373) and Written Opinion of the International Searching Authority (Form PCT/ISA/237) dated Apr. 19, 2011, issued in corresponding International Patent Application No. PCT/JP2009/065662 by the International Bureau of WIPO.

International Search Report (PCT/ISA/210) issued on Nov. 10, 2009, by Japanese Patent Office as the International Searching Authority for International Application No. PCT/JP2009/065662.

Office Action issued on Oct. 26, 2009, by Japanese Patent Office for Application No. 2008-239031.

Office Action issued on Mar. 10, 2010, by Japanese Patent Office for Application No. 2008-239031.

* cited by examiner

DEVELOPER CONVEYANCE DEVICE, DEVELOPING DEVICE, AND IMAGE FORMING DEVICE

This application is based on Japanese Patent Application No. 2008-239031 filed in Japan on Sep. 18, 2008, the entire content of which is hereby incorporated by reference.

BACKGROUND OF THE INVENTION

1. Field of the Invention

The present invention relates to a developer conveyance device for conveying a developer while converting a direction of this developer, a developing device being provided with this developer conveying device, and an image forming device that is adopted by a copy machine, a printer, a facsimile apparatus, or by a multifunction machine provided with these functions.

2. Description of the Related Art

Conventionally, as a developing device, one has been publicly known, in which, forming an agitating member on a rotation shaft of a first conveyance member, and agitating a developer by means of this agitating member, then, the developer is conveyed from a first circulation region to a second circulation region (for example, refer to Japanese Patent Application Laid-Open No. 2000-98715).

In addition, as other developing device, one has been publicly known, in which, conveying a developer while agitating the developer by means of a spiral wing member formed on a rotation shaft by rotating a mixing and agitating member, the developer is made into a turbulence state by a vertical wing member formed on the rotation shaft so as to improve an efficiency of mixture and agitation (for example, refer to Japanese Patent Application Laid-Open No. 6-167876).

However, according to the constitution described in Patent Document 1, as described in the paragraph of 0040 thereof, the agitating member merely has agitation ability and it is not provided with conveyance ability.

In addition, even in the constitution described in Patent Document 2, the vertical wing member is merely provided with the agitation ability as well as the constitution described in Japanese Patent Application Laid-Open No. 2000-98715.

Therefore, according to the present invention, it is an object to provide a developing device being provided with a function capable of effectively converting a conveyance direction of a developer while agitating the developer and an image forming device.

SUMMARY OF THE INVENTION

In accordance with one aspect of the present invention, there is provided a developer conveyance device including:

a developer container, in which a developer is contained; and a developer conveyance member being provided in the developer container, which conveys the contained developer from one end side of a delivery region to other end of the delivery region while agitating the contained developer;

characterized in that:

in the developer conveyance member, a spiral wing toward an axial direction is formed around a rotation shaft; a plurality of paddle parts for conveying the developer in a direction that is perpendicular to a shaft core are formed around the rotation shaft in a delivery region; and the paddle parts are arranged with their positions deviated in a circumferential direction.

According to this constitution, when the developer conveyance member is rotationally driven, the developer is conveyed in an axial direction by a spiral wing. Then, the developer is moved into a direction being perpendicular to the axial direction being agitated by the paddle parts that are formed in the delivery region. A plurality of paddle parts are formed to be arranged with its position being deviated in a circumferential direction. Then, due to the rotation of the developer conveyance member, the developer is scraped out by each of the paddles at various points in series with a temporal difference. As a result, the developer is less likely to be made into a clump even in the case that a flow property is worsen due to deterioration and environmental change of a degree of humidity and a temperature or the like, and the developer is agitated to convert its direction smoothly.

In the above aspect, the respective paddle parts are formed so that the areas in the region where the developer is moving upon rotation of the developer conveyance member are dissimilated.

According to this constitution, the position and the amount to scrape out the developer are varied depending on each paddle part, so that it becomes possible to further improve the agitation ability.

In the above aspect, the respective paddle parts are formed so that the areas are increased toward the end portion on the side where the delivery region is located.

According to this constitution, it becomes possible for the developer to be conveyed along the developer conveyance member to move in the direction being perpendicular to the axial direction more smoothly since it is possible to increase the scraped amount of the developer gradually as the developer moves to its conveyance direction.

In the above aspect, the respective paddle parts are formed so that the protrusion measurements from the rotation shaft are dissimilated.

In the above aspect, the respective paddle parts are formed so that the protrusion measurements are increased toward the end portion on the side where the delivery region is located.

In the above aspect, the respective paddle parts are formed so that the width measurements are dissimilated.

In the above aspect, the respective paddle parts are formed so that the width measurements are increased toward the end portion on the side where the delivery region is located.

In accordance with another aspect of the present invention, there is provided a developer conveyance device including:

a developer container, in which a developer is contained; and a developer conveyance member being provided in the developer container, which conveys the contained developer from one end side of a delivery region to other end of the delivery region while agitating the contained developer;

characterized in that:

the developer container has puddle parts to be arranged in the delivery region; and movement block parts for partially blocking the movement of the developer to be conveyed by the puddle parts in the vicinity of the region where the puddle parts are moving.

According to this constitution, even when the developer to be conveyed by the paddle parts is made into a clump, it is possible to forcibly agitate the developer by the movement block part.

In the above another aspect, the movement block parts are formed by a cantilever structure that is protruded from the inner surface of the developer container. Especially, the movement block parts are formed by line members.

If the above-described movement block parts are formed on the opposite sides of the region where the paddle parts are moving, this is preferable in that agitation of the developer can be made more effectively.

In accordance with still another aspect of the present invention, there is provided a developing device including:

a developer carrying member;

a developer container elongated from one end to other end along the developer carrying member, in which the developer is contained;

a first developer conveyance member provided in the developer container, which conveys the contained developer from one end side of a delivery region to other end of the delivery region while agitating the contained developer; and a second developer conveyance member provided in the developer container, which supplies the developer to the developer carrying member;

characterized in that:

the developer container has an inner space that is zoned into a first containing part and a second containing part by a partition wall that is elongated from one end side to other end side; and the first containing part and the second containing part are communicated with each other via a first opening part on one end side and a second opening part on other end side of a delivery region; and in the first developer conveyance member, a spiral wing toward an axial direction is formed around a rotation shaft; a plurality of paddle parts for conveying the developer in a direction that is perpendicular to a shaft core are formed around the rotation shaft in a delivery region; and the paddle parts are arranged with their positions deviated in a circumferential direction.

In addition, as means for solving the above-described problem, the present invention is constituted in such a manner that the developing device is provided with any of the above-described developer conveyance devices.

In addition, as means for solving the above-described problem, the present invention is constituted in such a manner that the image forming device is provided with any of the above-described developing devices.

According to the present invention, it is possible to convert effectively the direction of the developer from the axial direction to the direction being perpendicular to the axial direction since a plurality of paddle parts are formed in the delivery region of the developer conveyance member. Further, since the paddle parts are formed with its position being deviated to the circumferential direction, it is possible to scrape out the developer in series with a temporal difference. As a result, the agitating ability can be enhanced, and it becomes possible to convey the developer smoothly.

DETAILED DESCRIPTION OF THE PREFERRED EMBODIMENTS

Hereinafter, the embodiment(s) according to the present invention will be described with reference to the drawings. Further, in the following explanation, as necessary, the terms showing specific directions and positions (for example, "above", "below", "side", "end", and other terms including these terms) are used; however, these terms are used in order to make the understanding of the invention with reference to the drawings easy and due to meanings of these terms, the technical scope of the present invention is not limited.

(Constitution)

Figure 1:
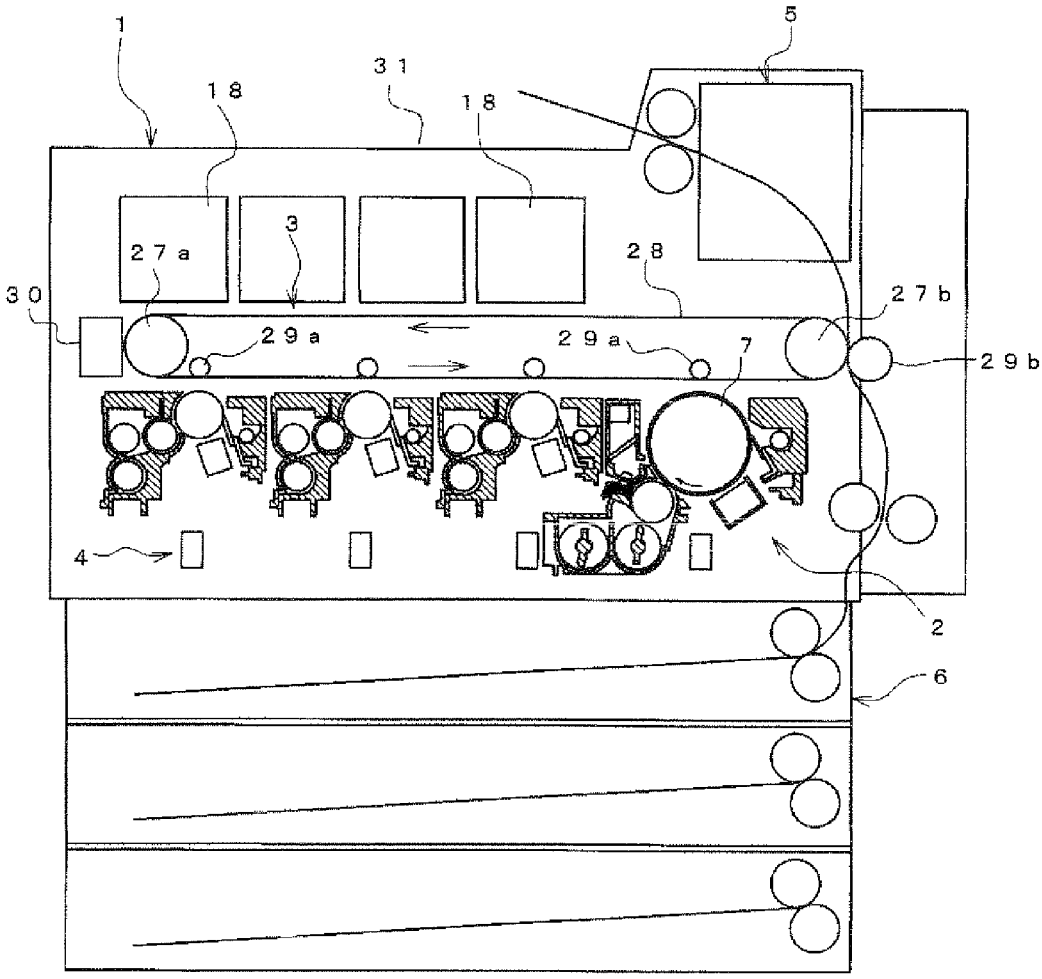
FIG. 1 is a schematic explanatory view of an image forming device according to the present embodiment.

FIG. 1 shows a tandem color image forming device applying an electro-photographic technology according to the present embodiment. However, the present invention is not only applied to this kind of image forming device 1, and for example, the present invention can be applied to a so-called four-cycle system color image forming device and the image forming device 1 of a black-and-white output. In addition, the present invention can be also applied to a copy machine, a printer, a facsimile apparatus, or by a multifunction machine provided with these functions.

The image forming device 1 shown in FIG. 1 is provided with an image forming unit 2, a transcription unit 3, an exposure unit 4, a fuser unit 5, and a paper feeding unit 6 or the like.

Figure 2:
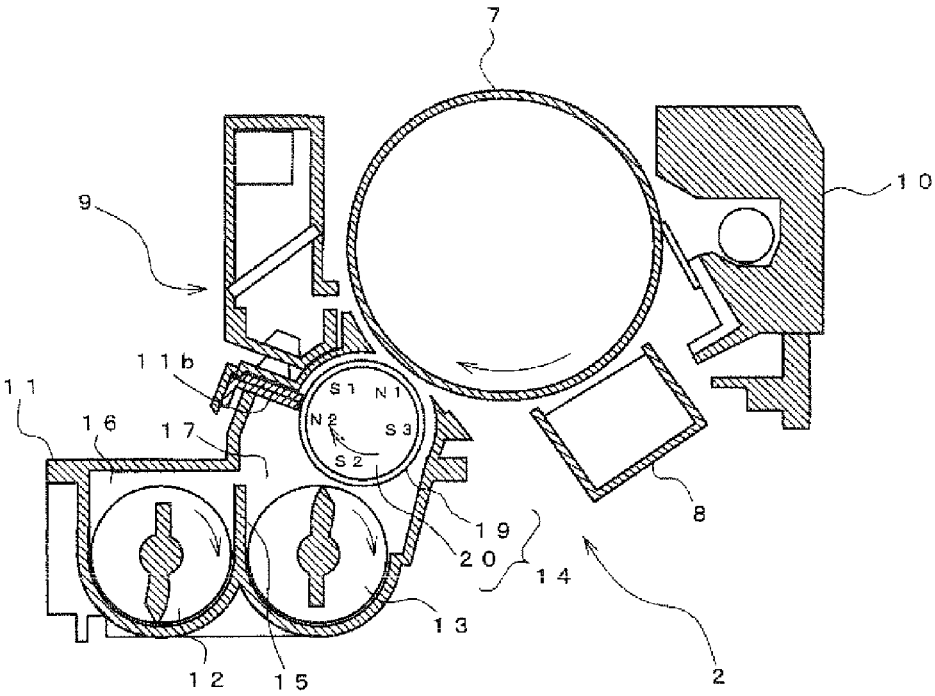
FIG. 2 is a schematic view showing an image forming unit of FIG. 1.

As shown in FIG. 2, the image forming unit 2 is provided with a charging device 8, a developing device 9, and a cleaning device 10 or the like around a photo conductor drum 7. In addition, the image forming units 2 are arranged at four places along an intermediate transcription belt 28 of the transcription unit 3 (refer to FIG. 1), and by forming images of yellow, magenta, cyan, and black, respectively, the image forming units 2 form a color image on the surface of the intermediate transcription belt 28.

In the photo conductor drum 7, its surface is uniformly charged when the photo conductor drum 7 is applied with a charge potential by the charging device 8, and an electrostatic latent image is formed when the photo conductor drum 7 is exposed by a laser beam to be irradiated from the exposure unit 4. This electrostatic latent image is imaged to be made into a toner image being provided with negatively-charged toner by the developing device 9. This toner image is transcribed on the surface of the intermediate transcription belt 28 by a positive voltage (a positive transcription potential) to be applied on the rear surface side of the intermediate transcription belt 28 by the transcription unit 3.

The developing device 9 contains a first developer conveyance member 12, a second developer conveyance member 13, and a developing roller 14 that is a carrying member of the developer within a developer container 11.

The developer container 11 is formed as a long box that is elongated from one end to other end, and the developer container 11 is divided into two parts by partition wall 15 extending along the longitudinal direction, namely, a first containing part 16 and a second containing part 17. In the first containing part 16, the first developer conveyance member 12 is contained. Then, the first containing part 16 is structured in such a manner that the developer is appropriately supplied from a corresponding developer cartridge 18 thereto (refer to FIG.

1). Here, as the developer, a binary developer composed of toner and a magnetic carrier is used as a developer. However, the developer containing an external addition agent or the like may be used. On the other hand, the second developer conveyance member 13 and the developing roller 14 are contained in the second containing part 17. Then, the second containing part 17 is structured so that the developer is appropriately discharged therefrom. In other words, this developer container is a so-called trickle system that supplies and discharges the developer in units of developer. In addition, the first containing part 16 is communicated with the second containing part 17 with each other via opening parts (a first opening part that is not illustrated and a second opening part 11*a*) that are formed on the opposite ends of a partition wall 15, and the developer can be circularly moved to be agitated. Further, a regulation blade 11*b* is protruded from the inner wall of the developer container 11 so that the amount of the developer to be supplied from the second developer conveyance member 13 to the developing roller 14 is regulated so as to be constant.

The developing roller 14 contains a plurality of permanent magnets 20 within a cylindrical sleeve 19. The permanent magnets 20 are fixed, and the sleeve 19 is structured so as to be rotated in a circumferential direction by sleeve driving means. In addition, the permanent magnets 20 are structured so as to be rotated forward and reversely in the circumferential direction along the inner circumferential surface of the sleeve 19 by magnet rotary driving means . As these driving means, for example, it is preferable that a motor capable of being rotated forward and reversely and having a controllable rotation position such as a servo motor and a stepping motor or the like is used.

Figure 3:
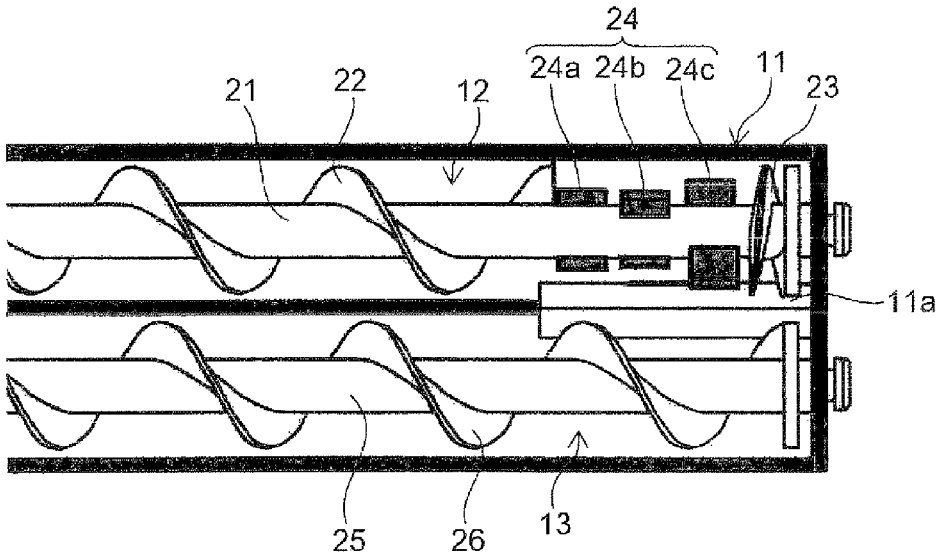
FIG. 3 is a sectional view showing a part of a developer container of FIG. 2.

As shown in FIG. 3, the first developer conveyance member 12 is structured in such a manner that a spiral first wing 22 and an auxiliary wing 23 with a spiral rotational direction opposite to this first wing 22 are formed on the outer circumferential surface of a first rotation shaft 21, and the first developer conveyance member 12 agitates the developer by the rotationally driving the developer while transporting the developer from one end side to other end side in a right direction of the drawing. On one end portion of the first developer conveyance member 12, conveyance paddles 24 are formed, which serve to convey the developer to the second containing part 17 via one opening part (the second opening part 11*a*) that is formed on the above-described developer container 11.

Figure 4:
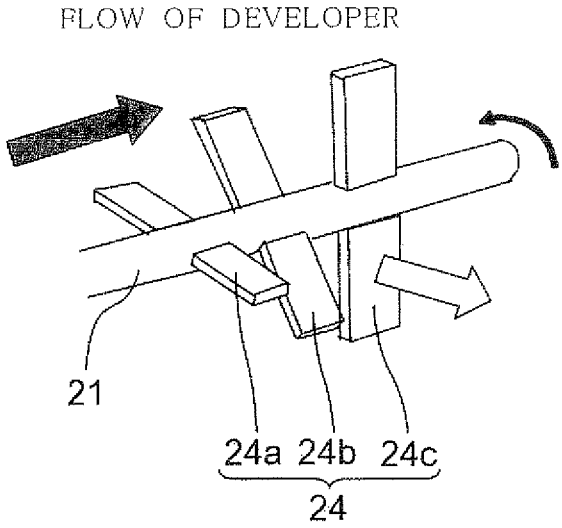
FIG. 4 is a partial perspective view showing a conveyance paddle that is provided on the first developer conveyance member of FIG. 3.
Figure 5:
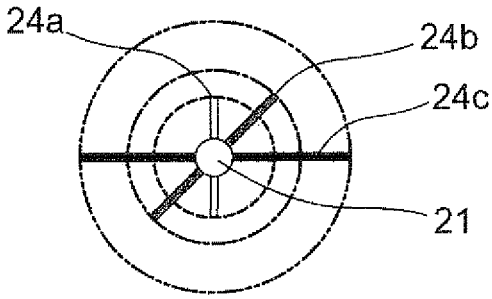
FIG. 5 is a side view showing the conveyance paddle of FIG. 4.

As shown from FIGS. 3 to 5, the conveyance paddles 24 are formed in the delivery region opposed to the second opening part 11*a* around the first rotation shaft 21. Three sets of conveyance paddles 24 are formed to be deviated in a rotational direction in pairs being protruded symmetrically with respect to a point around a shaft center of the first rotation shaft 21. Here, the conveyance paddles 24 of each set are made of a flat plane with the identical widths and thicknesses, and in FIG. 5, they are formed in such a manner that their positions are deviated by 45 degrees in a clockwise rotation and their protrusion measurements are increased gradually toward the end portion (hereinafter, from the set of a smaller protrusion measurement, described as a first conveyance paddle 24*a*, a second conveyance paddle 24*b*, and a third conveyance paddle 24*c*) . However, it is possible to enhance the agitation effect only by dissimilating respective positions of the paddles having the same lengths instead of forming respective conveyance paddles 24*a* to 24*c* so that their protrusion measurements are increased gradually toward the end portion. In addition, it is not necessary to provide the conveyance paddles 24 symmetrically; their positions are not limited to six places; and the deviation angles in a rotational direction are arbitrary.

As well as the above-described first developer conveyance member 12, the second developer conveyance member 13 is structured in such a manner that a spiral second wing 26 is formed on the outer circumferential surface of a second rotation shaft 25 to convey the developer from left in the drawing.

Further, in the first developer conveyance member 12, a paddle for agitation (not illustrated) may be provided other than the conveyance paddle 24. The paddle for agitation serves to prevent a cross-linkage from being generated in the developer to be conveyed by the spiral wing and more improve the agitation ability.

As shown in FIG. 1, the transcription unit 3 is structured in such a manner that the intermediate transcription belt 28 is rounded between a pair of rollers 27*a* and 27*b*, and by driving means (not illustrated), the intermediate transcription belt 28 is cyclically moved in an arrow direction. The transcription unit 3 is provided with a primary transcription part and a secondary transcription part. The primary transcription part is provided with a primary transcription roller 29*a* being opposed to the photo conductor drum 7 in a state of nipping the intermediate transcription belt 28. The primary transcription roller 29*a* applies a positive voltage on the rear surface of the intermediate transcription belt 28. The secondary transcription part is provided with a secondary transcription roller 29*b* being opposed to one roller 27*a*. The secondary transcription roller 29*b* applies a positive voltage on the rear surface of the intermediate transcription belt 28. A toner image transcribed on the intermediate transcription belt 28 is to be transcribed on a recording medium (for example, paper).

Further, in the vicinity of one roller 27*a* of the transcription unit 3, a cleaning unit 30 is placed. The cleaning unit 30 is capable of being contacted with and being detached from the intermediate transcription belt 28, and the cleaning unit 30 collects the remaining toner on the surface of the intermediate transcription belt 28 when the cleaning unit 30 approaches the intermediate transcription belt 28.

The exposure unit 4 irradiates a laser beam to the above-described photo conductor drum 7 to form an electrostatic latent image corresponding to the image data that is read by a scanner (not illustrated).

The fuser unit 5 supports a fuser roller and a pressure roller so as to be capable of being rotated although the fuser roller and the pressure roller are not illustrated. The fuser roller is made of a conductive material, and the fuser roller is rotatably driven by a motor (not illustrated) and is inductively heated by an exciting coil (not illustrated). The pressure roller is brought into contact with the fuser roller by pressure to clip the recording medium between these rollers. Thereby, it is possible to fix the toner that is transcribed by the transcription unit 3 on the recording medium.

A paper feeding unit 6 conveys the recording media contained in a cassette 25 in series to the secondary transcription part via a plurality of conveyance rollers to transcribe the toner image, and after fixing the toner image that is transcribed by the fuser unit 5, the paper feeding unit 6 conveys the recording media to a discharge tray 31.

(Operation)

Next, the operation of the image forming device 1 formed by the above-described constitution, particularly, the operation of the developing device 9 will be described.

The color print data that is obtained by reading the image by an image reading part (not illustrated), or the image data that is outputted from a personal computer or the like is inputted in the image forming device 1 after being applied with predetermined signal processing by a control part (not illustrated). The image forming device 1 modulates the laser beam on the basis of the inputted image data to form a latent image by projecting the modulated laser beam to the photo conductor drum 7.

In the developing device 9, the developer is supplied to the inside of the first containing part 16 of the developer container 11. The supplied developer is conveyed in the axial direction in series by the first wing 22 depending on the rotation of the first developer conveyance member 12. The developer is moved to one end side to be conveyed to the second containing part 17 via the second opening part 11*a* due to the pressure generated by conveyance and the operation of the conveyance paddles 24.

In the meantime, as described above, the conveyance paddles 24 are formed by a total of three sets with each set composed of two paddles that are formed deviated in a rotation direction, and further, their protrusion measurements are increased gradually toward the end portion. As a result, the developer to be conveyed in the axial direction of the first rotation shaft 21 is scraped out to the side of the second opening part 11*a* that is perpendicular to the shaft core by the first conveyance paddle 24*a*. According to the scraping operation by means of the first conveyance paddle 24*a*, it is possible to naturally convert the direction of part of the developer and convey it since the protrusion measurement is small. Then, by the second conveyance paddle 24*b* with a large protrusion measurement, the remaining of the developer partially scraped out by the first conveyance paddle 24*a* is further partially scraped out with a temporal difference. At last, if the remaining developer can not be completely scraped out by the first and second conveyance paddles 24*a* and 24*b* and is provided with friction and pressure by the auxiliary wing 23, this remaining developer is further scraped out by the third conveyance paddle 24*c* of the largest protrusion measurement with a temporal difference.

Thus, the first to third conveyance paddles 24*a* to 24*c* convey the developer in series while converting the direction of part of the developer. As a result, without placing an unreasonable load to the conveyance paddles 24, it becomes possible to control the driving force, which is required by the driving means of the first developer conveyance member 12. Further, it is possible to scrape out the developer with a temporal difference since each position of the conveyance paddles 24*a*, 24*b*, and 24*c* is deviated in the rotation direction of the first rotation shaft 21. Accordingly, the developer can be effectively agitated, so that the developer smoothly passes through the second opening part 11*a*.

In the second containing part 17, the developer is conveyed in the axial direction by the second wing 26 due to the rotation of the second developer conveyance member 13. Then, the developer moved to one end side is returned to the inside of the first containing part 16 via the first opening part due to the pressure generated by conveyance to be cyclically moved.

In the photo conductor drum 7, the latent image is formed as described above, so that a toner image in response to the latent image is formed by supply of the developer from the developing roller 14. The formed toner images are primarily transcribed being superimposed with each other on the moving intermediate transcription belt 28 in series by the operation of the primary transcription roller 29*a*. The toner images that are formed on the intermediate transcription belt 28 are moved to the side of the secondary transcription part 29*b* in accordance with the movement of the intermediate transcription belt 28.

In addition, paper sheets are supplied from the paper feeding unit 6. The supplied paper sheet is conveyed between the secondary transcription part 29*b* and the intermediate transcription belt 28 by the conveyance roller, and then, the toner images formed on the intermediate transcription belt 28 are transcribed.

(Other Embodiment(s))

Further, the present invention is not limited to the constitution that is described in the above-described embodiment, and various modifications can be made.

Figure 6:
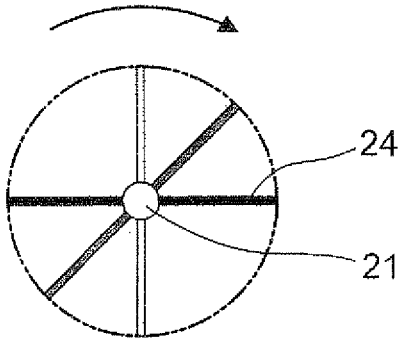
FIG. 6 is a side view showing a conveyance paddle according to other embodiment.
Figure 7A:
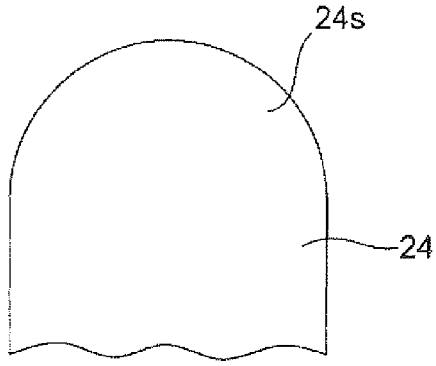
FIGS. 7A, 7B, 7C and 7D are plan views showing a front end shape of the conveyance paddle according to other embodiment.
Figure 7B:
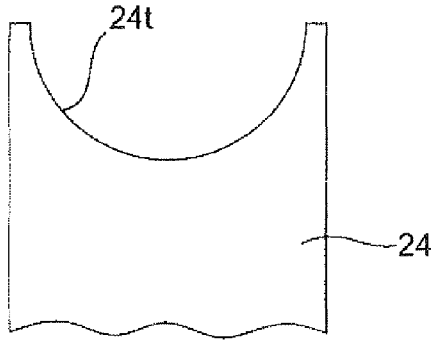
Figure 7C:
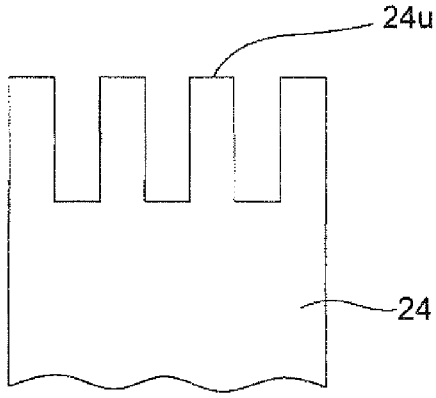
Figure 7D:
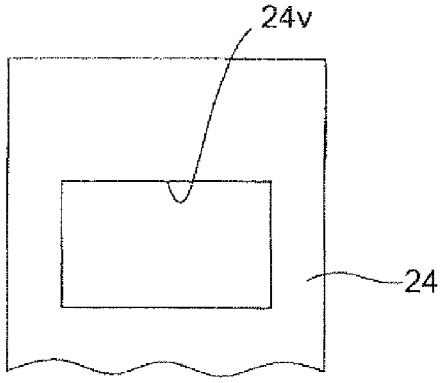

According to the above-described embodiment, the protrusion measurements of the conveyance paddles 24 from the first rotation shaft 21 are dissimilated; however, as shown in FIG. 6, they may have the same protrusion measurements. In addition, the width measurements may be dissimilated. In this case, it is preferable that the width measurement is increased gradually toward the end portion of the first rotation shaft 21. Further, both of the height and the width measurement may be dissimilated. The bottom line is that respective conveyance paddles 24 may be formed so that the areas in the region where the developer is moving are dissimilated in order to dissimilate the amount of the developer that is scraped out by each of the conveyance paddles 24. Furthermore, the front shape of each of the conveyance paddles 24 is formed as a rectangular shape; however, other shapes may be available. In FIG. 7A, a semicircular part 24*s* is formed at a free end portion. In FIG. 7B, a semicircular recess 24*t* are formed at a free end portion. In FIG. 7C, teeth 24*u* are formed at a free end portion. In FIG. 7D, an opening part 24*v* (for example, it may be formed as a rectangular shape; however, a circular shape and other shapes may be available) is formed at a free end portion. These shapes are excellent in capable of improving agitation and a loosening ability of the developer as compared to a mere flat shape.

Figure 8:
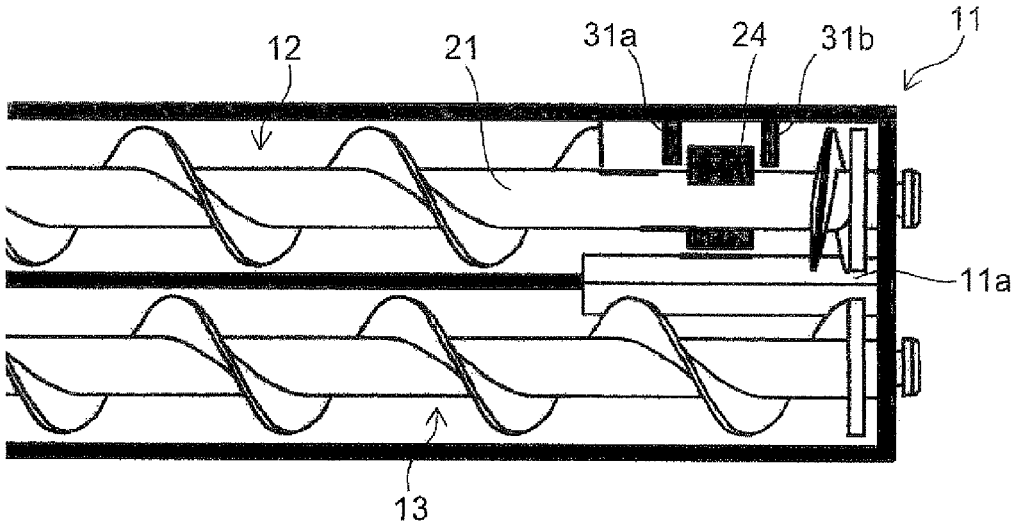
FIG. 8 is a sectional view showing a part of a developer container according to other embodiment.
Figure 9A:
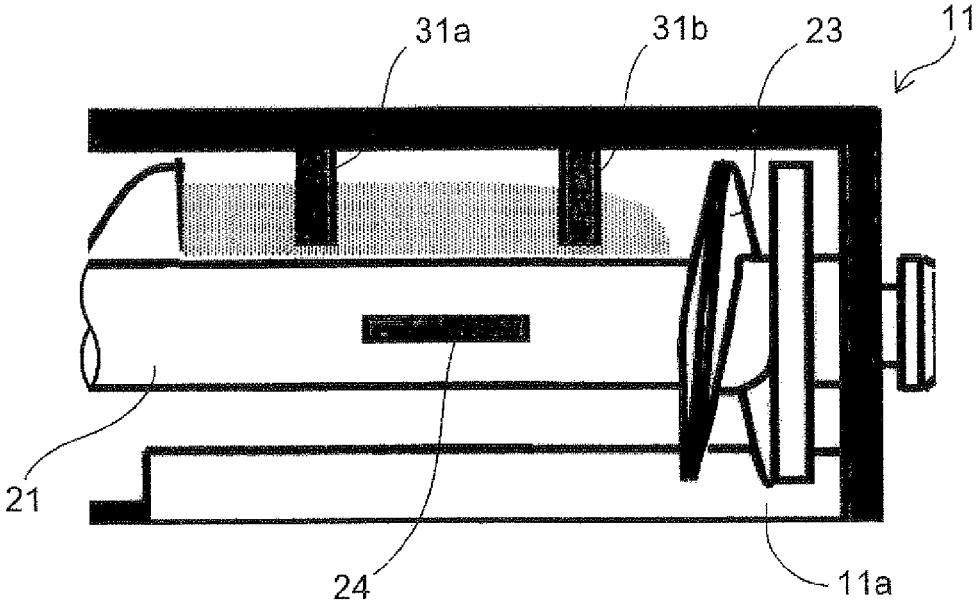
FIG. 9A is a partial enlarged view of FIG. 8.
Figure 9B:
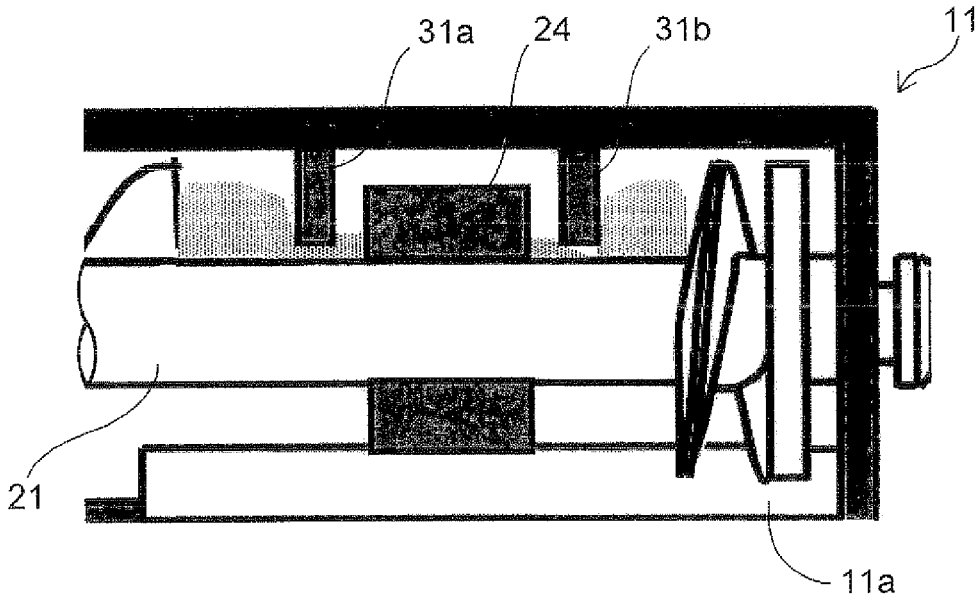
FIG. 9B is a partial enlarged view showing the state that the first developer conveyance member is rotated from the position of FIG. 9A by 90 degrees.

As shown in FIG. 8, protruding a pair of conveyance paddles 24 symmetrically from the first rotation shaft 21, movement block parts 31*a* and 31*b* are formed on the opposite sides of the region where the developer is moving so as to be protruded from the inner wall of the developer container 11. The movement block parts 31*a* and 31*b* are formed as rectangular shapes, and their front ends are elongated to the vicinity of the first rotation shaft 21 to be located on the opposite side of the second opening part 11*a*. One movement block part 31*a* blocks conveyance of a part of the developer that is conveyed in the axial direction by the first developer conveyance member 12 any more. In addition, by means of the both block parts 31*a* and 31*b*, the conveyance paddles 24 are rotated from the position shown in FIG. 9A to forcibly divide the developer having its direction converted toward the second opening part 11*a* being perpendicular to the axial direction of the first rotation shaft 21 from the first rotation shaft 21 into three regions as shown in FIG. 9B. In other words, since the developer is conveyed in the axial direction while pivoting by the first wing 22 of the first developer conveyance member 12, the cross-linkage is easily generated on the outer circumferential side of the first rotation shaft 21; however, the developer can be certainly divided by the movement block parts 31*a* and 31*b*. As a result, it is possible to convey the developer while smoothly converting the direction of the developer from the first containing part 16 to the second containing part 17 via the second opening part 11*a*.

Figure 10:
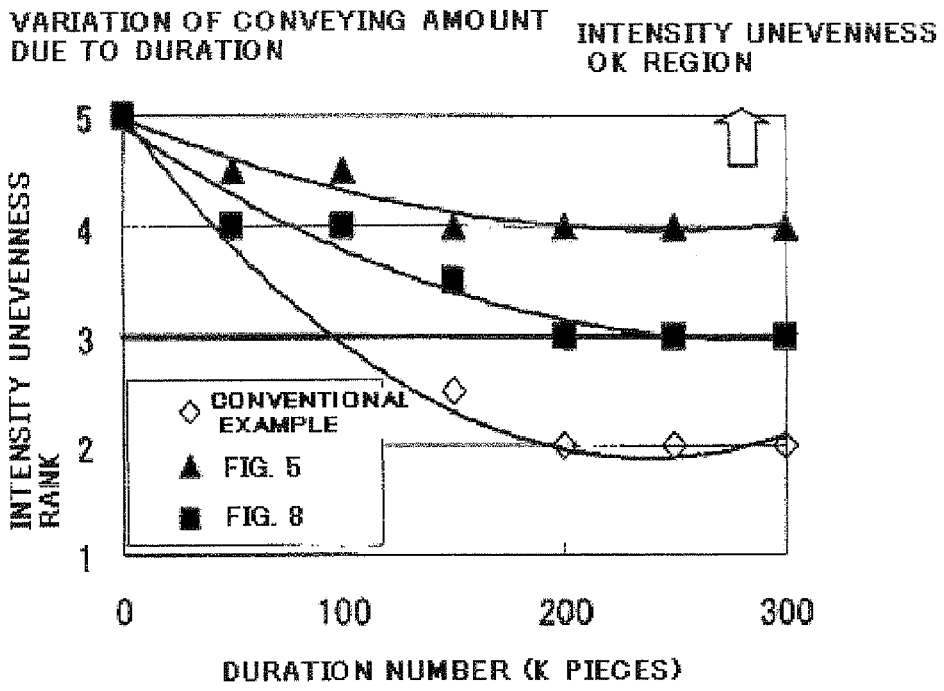
FIG. 10 is a graph showing a relation between the durable number of sheets and the ranks of image density unevenness.

FIG. 10 is a graph showing results of verifying a relation between the durable number of sheets and the levels of image density unevenness in the case that the conveyance paddles 24 are not provided conventionally; in the case that three sets of the conveyance paddles 24 (six paddles in total) are provided, the protrusion measurements are dissimilated in each set, and the positions of all paddles are deviated in the circumferential direction as shown in FIG. 5; and in the case that one piece of conveyance paddle 24 is provided, and on the opposite sides of it, the movement block parts 31*a* and 31*b* are arranged as shown in FIG. 8. Here, the level of the image density unevenness is defined as follows: the case that there is absolutely no unevenness in the image is defined as a rank 5; the case that the full image is uneven is defined as a rank 1; and a level of unevenness between the rank 5 and the rank 1 is defined as ranks 4 to 2, respectively.

Here, a gap measurement between the developing roller 14 and the photo conductor drum 7 (the gap measurement at the closest position) is regulated to be 0.27 mm; a ratio of the tonner in the developer (a toner ratio) is regulated to be 7%; and the conveyance amount of the developer is regulated to be 200 g/m$^2$. According to the example of FIG. 5, the protrusion measurements of the first, second, and third conveyance paddles 24*a*, 24*b*, and 24*c* from the first rotation shaft 21 are defined to be 4 mm, 5 mm, and 6 mm (the width measurement 4 mm, and the thickness 1 mm) , and the first, second, and third conveyance paddles 24*a*, 24*b*, and 24*c* are arranged with the interval of 2 mm in the axial direction, namely, with a pitch of 6 mm. According to the example of FIG. 8, the protrusion measurement, the width measurement, and the thickness of the conveyance paddle 24 are defined to be 6 mm, 15 mm, and 1 mm, respectively; and the protrusion measurement from the inner wall of the movement block parts 31, the width measurement, and the thickness are defined to be 4 mm (the gap from the first rotation shaft 21 is 4.5 mm), 2 mm, and 1 mm, respectively.

As a result, in the conventional developer container having no conveyance paddle 24, the more the durable number of sheets is increased, the more the image density unevenness rank is lowered, and the rank is lower than 3, which is an acceptable rank, when the duration number is about 100. On the contrary, according to the example of FIG. 5, the acceptable rank 3 is maintained when the duration number is about 300, and according to the example of FIG. 8, the excellent result such that the rank 4 is maintained when the duration number is about 300 is obtained.

In addition, the above-described developer conveyance device is not limited to the developing device 9, and any device can be employed as long as it is provided with a mechanism for changing the conveyance direction of the developer and moving the developer to other place, for example, developer replenishing means for replenishing the developer to the developing device, and waste toner discharging means for collecting the toner remaining on the photo conductor and discharging it, or the like.

What is claimed is:

1. A developer conveyance device, comprising:

a developer container, in which a developer is contained;

a partition wall that divides an inner space of the developer container into a first containing part and a second containing part, a first opening is formed at one end of the partition wall, and a second opening is formed at an opposite end of the partition wall; and a developer conveyance member provided in said developer container, which conveys the contained developer in a conveyance direction from one end side of the developer container to an other end of the developer container while agitating the contained developer;

wherein in said developer conveyance member, a spiral wing toward an axial direction is formed around a rotation shaft; a plurality of paddle parts for conveying the developer in a direction that is perpendicular to a shaft core toward the second opening are formed around the rotation shaft in a delivery region over the second opening; and said paddle parts are arranged with their positions deviated in a circumferential direction and one paddle part positioned downstream in the conveyance direction has a larger area than a paddle part positioned upstream in the conveyance direction.

2. The developer conveyance device according to claim 1, wherein:

said paddle parts are formed so that protrusion measurements from the rotation shaft are dissimilated.

3. The developer conveyance device according to claim 2, wherein:

said paddle parts are formed so that the protrusion measurements are increased toward the end portion on the side where the delivery region is located.

4. A developing device, comprising the developer conveyance device according to claim 3.

5. A developing device, comprising the developer conveyance device according to claim 2.

6. The developer conveyance device according to claim 1, wherein:

said paddle parts are formed so that width measurements are dissimilated.

7. The developer conveyance device according to claim 6, wherein:

said paddle parts are formed so that the width measurements are increased toward the end portion on the side where the delivery region is located.

8. A developing device, comprising the developer conveyance device according to claim 7.

9. A developing device, comprising the developer conveyance device according to claim 6.

10. A developing device, comprising the developer conveyance device according to claim 1.

11. An image forming device, comprising the developing device according to claim 10.

12. The developer conveyance device according to claim 1, wherein the front of at least one of the paddle parts has a semicircular shape.

13. The developer conveyance device according to claim 1, wherein the front of at least one of the paddle parts has a semicircular recess shape.

14. The developer conveyance device according to claim 1, wherein the front of at least one of the paddle parts has a plurality of teeth.

15. The developer conveyance device according to claim 1, wherein the front of at least one of the paddle parts has an aperture.

16. The developer conveyance device according to claim 1, wherein the plurality of paddle parts comprise pairs of paddle parts, each pair of paddle parts having two paddle parts that are diametrically opposed from each other on opposite sides of the rotation shaft, and said pairs of paddle parts are arranged with their positions deviated in a circumferential direction.

17. A developer conveyance device, comprising:

a developer container, in which a developer is contained, having an axial direction and a partition wall extending the axial direction of the developer container, the partition wall dividing the interior of the developer container into a first region and a second region which communicate with each other via an opening at one axial end of the partition wall; and a developer conveyance member being provided in said developer container, which conveys the contained developer from one end side of the first region to an other end side of the first region while agitating the contained developer;

wherein said developer container has paddle parts arranged in the first region over the opening at the one axial end of the partition wall; and movement block parts over the opening at the one axial end of the partition wall for partially blocking the movement of the developer to be conveyed by the paddle parts in the vicinity of the region where the paddle parts are moving.

18. The developer conveyance device according to claim 17, wherein:

said movement block parts are formed by a cantilever structure that is protruded from the inner surface of the developer container.

19. The developer conveyance device according to claim 18, wherein:

said movement block parts are formed on the opposite sides of the paddle parts.

20. The developer conveyance device according to claim 17, wherein:

said movement block parts are formed on the opposite sides of the paddle parts.

21. A developing device, comprising:

a developer carrying member;

a developer container elongated from one end to an other end along said developer carrying member, in which developer is contained;

a first developer conveyance member provided in said developer container, which conveys the contained developer from one end side of the developer container to an other end of the the developer container while agitating the contained developer; and a second developer conveyance member provided in said developer container, which supplies the developer to said developer carrying member;

wherein said developer container has an inner space that is zoned into a first containing part and a second containing part by a partition wall that is elongated from one end side to an other end side; and the first containing part and the second containing part are communicated with each other via a first opening part on one end side and a second opening part on other end side of a delivery region; and in said first developer conveyance member, a spiral wing toward an axial direction is formed around a rotation shaft; a plurality of paddle parts for conveying the developer in a direction that is perpendicular to a shaft core toward the second opening is formed around the rotation shaft in a delivery region over the second opening; and said paddle parts are arranged with their positions deviated in a circumferential direction and one paddle part positioned downstream in the conveyance direction has a larger area than a paddle part positioned upstream in the conveyance direction.

* * * * *